United States Patent [19]

Shoger

[11] 4,018,438

[45] Apr. 19, 1977

[54] RECREATIONAL JOUNCING APPARATUS WITH VERTICAL SUPPORTS AND REMOVABLE BOARD TRAVEL STOPS

[76] Inventor: James Shoger, 10 S. 391 Washington St., Naperville, Ill. 60540

[22] Filed: June 9, 1975

[21] Appl. No.: 584,758

[52] U.S. Cl. ..... 272/65; 248/251; 108/102; 108/105

[51] Int. Cl.[2] ..... A63B 5/00

[58] Field of Search ..... 272/57 R, DIG. 4, 58, 272/62, 76, 60, 65, 144, 93, 109; 108/59, 102, 105; 211/68; 248/251

[56] References Cited

UNITED STATES PATENTS

| | | | |
|---|---|---|---|
| 1,351,053 | 8/1920 | Macklem | 272/60 R |
| 1,752,110 | 3/1930 | Remy | 272/60 A X |
| 3,404,884 | 10/1968 | Jorenson et al. | 272/60 R |

*Primary Examiner*—Harland S. Skogquist
*Assistant Examiner*—William R. Browne
*Attorney, Agent, or Firm*—Heise & Coolahan

[57] ABSTRACT

An assembable jouncing apparatus having a pair of portable and adjustable stanchions selectively positionable in space relation and operative to support a board therebetween at selective distances from the ground or floor; each stanchion including a board supporting member operative to receive and transmit maximum vertical and minimal horizontal force components to the stanchions from the board as it is downwardly deflected therebetween. The board being loosely retained between the stanchions by removable devices secure at each end portion of the board.

11 Claims, 5 Drawing Figures

RECREATIONAL JOUNCING APPARATUS WITH VERTICAL SUPPORTS AND REMOVABLE BOARD TRAVEL STOPS

BACKGROUND OF THE INVENTION

The invention is directed toward recreation devices commonly referred to as jouncing boards. Generally a resilient board made of wood or even of fiberglass construction is disposed between space apart supports and a person jounces at the center region of the board causing it to deflect and rebound. If the board is merely placed on block or the like its motion during use will cause it to move off the block, requiring it to be replaced periodically. Also if the supporting blocks are not secured to the ground or floor the forces transmitted by the board to the supporting blocks together with the boards movement during deflection will cause the blocks to creep and move requiring them to continually reposition.

Others have directed attention to providing a board being securely fastened at each end to a structure having members that pivot or displace to accomodate the boards movement during deflection. One disadvantage is that such a structure is bulky to transport and store. Also with such a structure the distance between the place at which the board is secure is fixed and the board itself cannot easily be replaced with other boards of different jouncing characteristics.

A general object of the invention is to provide a jouncing apparatus which loosely retains a jouncing board between portable stanchions the distance between which can be selected.

Another object of the invention is to provide a jouncing apparatus which is easily assembled and disassembled for storage and transportation.

A still further object of the invention is to provide a jouncing apparatus which is adjustable to selectively position the board at various distances from the floor or ground.

A still other further object of the invention is to provide a supporting member for each stanchion which provides a sliding surface for the board and is operative to minimize the horizontal and maximize the vertical component of forces to the stanchions from the board as it is downwardly deflected during use.

Still another object of the invention is to provide devices removably secured to each end portion of the board effective to loosely retain the board in spanning relation between the stanchions.

A still further object of the invention is to provide that the jouncing board can be easily interchanged with other jouncing boards of different jouncing characteristics.

The foregoing and other advantages and features of the invention will be apparent from the following more particular description of the preferred embodiment of the invention as illustrated in the accompanying drawings.

DESCRIPTION OF THE PREFERRED EMBODIMENT

Figure 1:
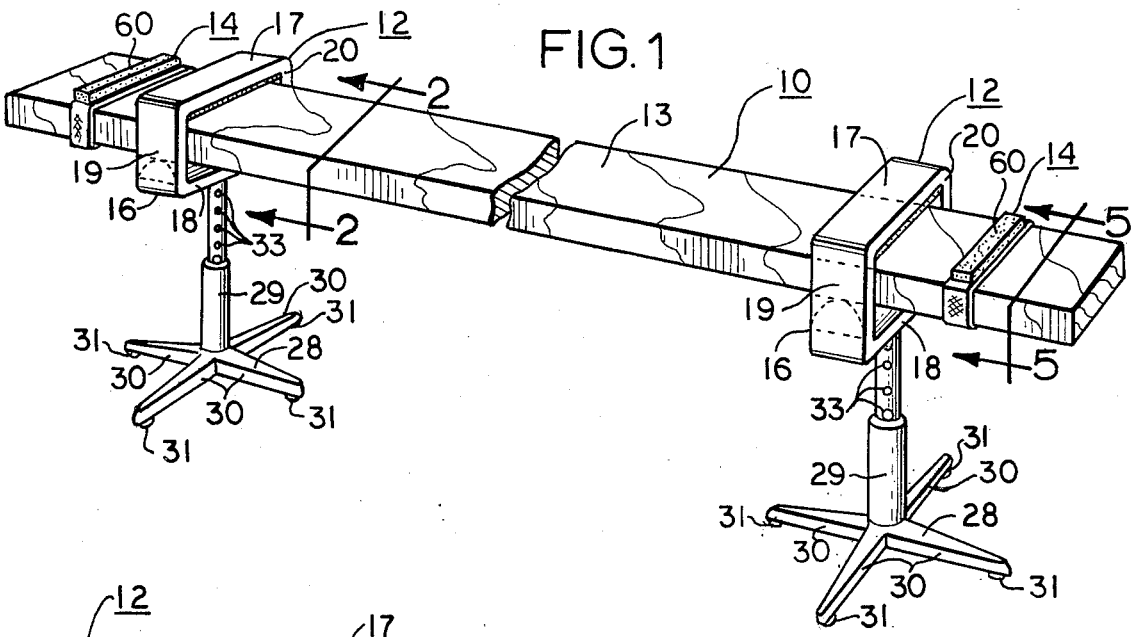
FIG. 1 is a perspective view showing the novel jouncing apparatus with the center portion of the jouncing board cut away.

Turning attention to FIG. 1, the invention generally designated 10 is shown in assembled mode.

As seen in FIG. 1, the invention comprises a pair of support means, generally designated 12, a jouncing board 13 and a pair of board retaining means, generally designated 14. It is pointed out at this time that each of the support means 12 are substantially identical and therefore the same number will be used in the designation and identification of similar and corresponding parts; also the description hereinafter set forth will apply to each. The above method of designation and description will also apply to the retaining means 14.

Figure 2:
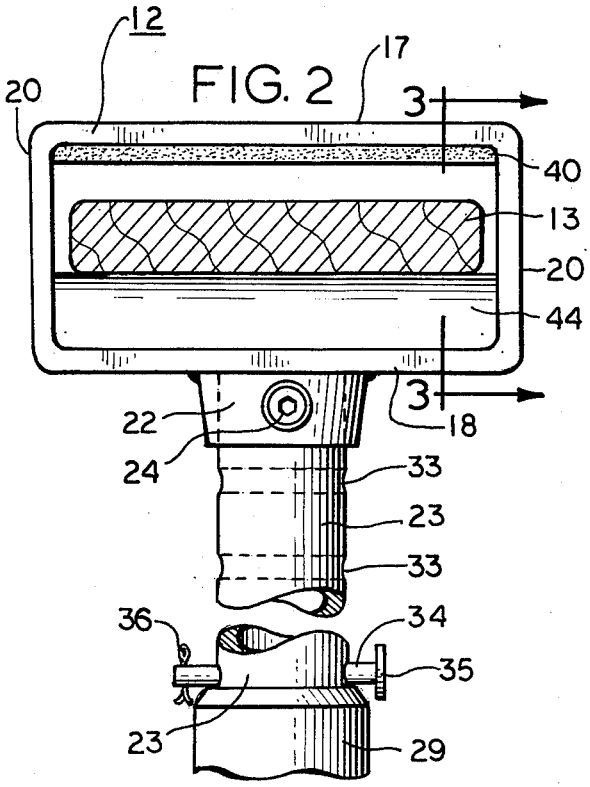
FIG. 2 is a view taken substantially at line 2—2 of FIG. 1 and showing the jouncing board in section view and a portion of one of the support means in elevation view.
Figure 3:
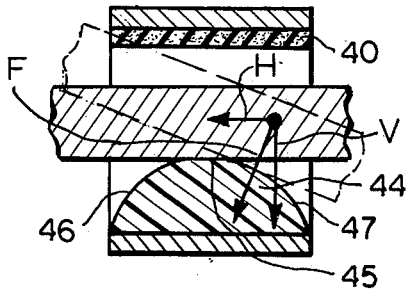
FIG. 3 is a sectional view of a portion of the apparatus taken substantially at line 3—3 of FIG. 2.

Describing in the invention in detail and having particular references to the support means 12, attention is directed to FIGS. 1, 2 and 3. The support means 12 comprises a frame member 16 of generally rectangular shape having top, bottom and opposing side walls designated 17, 18, 19 and 20 respectively. A hub 22 is secured to the lower center portion of the bottom wall 18 by welding or other means well known to those skilled in the art. The hub 22 receives the upper end of an upright cylindrical tube 23 and is fastened thereto by set screw 24. The lower portion of the support means 12 comprises a base 28 having a tubular upright portion 29 extending downwardly to merge with four outwardly extending, and substantially identical feet 30 which are spaced apart at substantially 90 degree intervals. At the end and bottom portion of each foot is secured a rubber pad 31 which is operative to retard movement of base 28 during use of the jouncing apparatus. The lower end of the cylindrical tube 23 is received into the tubular portion 29 in telescoping relation. The cylindrical tube 23 has a series of holes 33 spaced apart along its length and extending therethrough. These holes 33 each can selectively receive a pin 34 (FIG. 2). The pin 34 at one end has a head 35 and a hole at the other end thereof to receive a cotter pin 36, or the like, to secure the pin 34 in the selected hole. It can be seen that the frame member 16 can thereby be selectively positioned at a plurality of selected heights relative to the floor or ground.

A padding 40 is secured by adhesive to the inner portion of the top wall 17 of frame member 16. This padding 40 cushions the impact of the jouncing board 13 on the top wall 17 during recoil of the board 13 when it is flexing in an upward direction.

One of the novel features of the instant invention is seen in the FIGS. 1 through 3 the jouncing board 13 is supported on a supporting member 44. The member 44 in cross sectional view has a curved configuration including a flat apex surface area 45 which merges into substantially identical curved surface areas 46 and 47 defining edge portions thereat. It can be seen that the board 13 at rest is substantially in contact with the entire flat apex surface 45. However, upon downward deflection of the board (FIG. 3) the board rocks downwardly onto the curved surface 47 (or 46 depending on the positioning of the support means 12). When this occurs the forces transmitted to the support means 12 by the board 13 are transferred along a line substantially perpendicular to the tangent of the curve portion 47 at the point where the board 13 is in contact with the surface 47 (or 46). The vector diagram of FIG. 3 shows the force F transmitted to the support member together with the horizontal and vertical components thereof, designated H and V respectively. It can be observed that such a configuration in the supporting member 12 provides that the vertical force component V will remain substantially larger as compared to horizontal force component H during anticipated magnitudes of deflection during operation. This minimal horizontal force component during operation assures stability and reduces and will practically eliminate creeping of the support means during normal operation.

Figure 4:
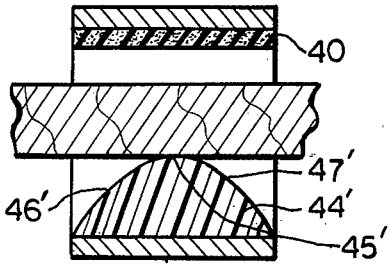
FIG. 4 is a sectional view of another embodiment of that portion of the apparatus shown in FIG. 3.

FIG. 4 illustrates another embodiment of the support member described in FIG. 3. This support member is designated 44' with a substantially curved apex surface 45'. As in FIG. 3 the curved surfaces 46' and 47' extending from the apex 44' are each substantially identically curved such that the support means can be positioned at 180 degree intervals without change in operation. The function and operation of this embodiment is substantially the same as that described in the embodiment of FIG. 3.

The board 13 generally would be of wood having the general dimensions of about 1¼ inches thick by 12 inches wide by 12 to 14 feet long. However, boards of different thickness, widths, lengths and material could be used depending on the size of the operators or the amount of jouncing action desired. The instant invention can accomodate any number of boards of different sizes and materials with requiring modification of the apparatus.

Figure 5:
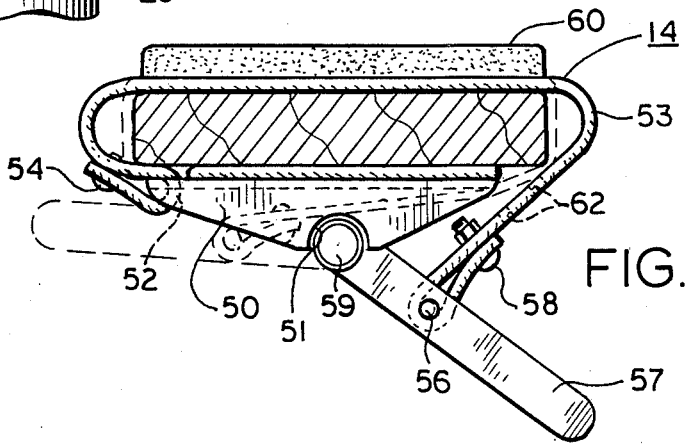
FIG. 5 is a view taken substantially at line 5—5 of FIG. 1 and showing the jouncing board in sectional view in a jouncing board retaining device in elevational view.

The board 13, as shown in FIG. 1, is retained in support position between the support means 12 by means of the board retaining means 14, one of each is fastened at opposite end portions of the board. The retaining means comprises a block 50 having a transverse semicylindrical groove 51 in the outward portion thereof and located off-center relative to the length thereof as shown in FIG. 5. At one end of the block 50 is a slat 52 which receives a flexible strap 53. The strap 53 is threaded through the slat 52 and is secured to itself by a rivet 54. It can be seen that this forms a loop which flexibly retains that end of the strap 53 to the block 50. The other end of the strap 53 loops about pin 56 which is secured to a handle 57 at spaced relation to the end thereof. Here again this end of the strap 53 is secured to itself by bolt 58. At one end of the handle 57 is secured a cylindrical pivot member 59 in normal relation thereto and is of such dimension to snugly fit in the groove 51 of the block 50. A rubber bumper 60 is secured to the strap 53, by gluing or other means well known to those skilled in the art at a location on the outward surface of the strap 53 such that when the retaining means 14 is clamped about the board 13 the bumper is positioned substantially over the upper surface of the board 13. It can be seen in FIG. 5 that the retaining means 14 operates as a toggle device which can be slipped over the end of the board 13. The pivot member 59 is then placed in the groove 51 of the block 50 and the handle 57 is rotated about as shown by the arrow in FIG. 5. It can be seen that when the handle 57 is rotated to its full extent the strap 53 is drawn tightly about the board 13 and secured thereto. It can be appreciated that toggle operation as hereinbefore described secures the retaining means 14 about the board 13 until the handle 57 is manually rotated to its original position. Also the handle end of the strap 53 has a series of spaced-apart holes 62 which can receive the bolt 58 thereby providing for lengthing or shortening the effective length of the strap 53 to accomodate boards of varying dimensions.

In operation the support means 12 are placed in aligned spaced apart relation as shown in FIG. 1. If a particular height is desired this can be easily adjusted by removing member 34 and either raising or lowering the frame member 16 as hereinbefore described. The board 13 is inserted through each frame member 14 and positioned on each supporting member 44. Then on each end portion of the board 13 is secured the board retaining means 14 in a manner as hereinbefore described. The jouncing apparatus is now ready for use.

During use the operator jounces on the center portions of the board. As the board deflects it can easily move and ride along each of the supporting members and yet because of their configuration the forces transmitted thereto are substantially vertical in direction.

Also it can be readily appreciated that after use the instant apparatus can easily be disassembled for transporting and storage; with such taking up minimal space. It should also be noted that jouncing boards having different jouncing characteristics are desired, these can be interchanged quickly and easily.

It will be appreciated that the embodiment of the invention has been chosen for the purposes of illustration and description herein is that preferred based upon requirements for achieving the objects of the invention and developing the utility thereof in a most desirable manner. It will be understood, that the particular structure and functional aspect emphasized herein are not intended exclude but rather to suggest other such modifications and adaptations as fall within spirit and scope of the invention as hereinbefore described.

What is claimed is:

1. An assemblable jouncing apparatus comprising:

a jouncing board;

a pair of support means effective to loosely support said board above the ground, each engaging said board in supporting relation at selected distances from the ends thereof; each said support means including a supporting member having a configuration defining supporting surfaces upon which said board longitudinally moves during downward deflection thereof;

said support means including a support member having an arcuate board engaging surface so that the downward vertical component of force transmitted by said board to each said support member during said deflection are substantially larger than horizontal component of same force; and removable board retaining means selectively disposed and positionable on said board at locations adjacent the board support means to retain said board in supporting relation between said support means while users are jouncing.

2. The invention as recited in claim 1 wherein said support means comprises a frame member having upper and lower portions defining an aperture for receiving an end portion of the board therethrough, and said supporting member disposed within said aperture.

3. The invention as recited in claim 2 wherein said supporting member is disposed on the lower portion of said frame member, and said supporting surfaces comprising a flat apex portion and curved surface portions flanking and extending downwardly from said apex portion wherein said board rests on said apex portion and rides on to one of said curved surface portions during downward deflection of said board.

4. The invention as recited in claim 2 wherein said supporting member is disposed on the lower portion of said frame member, and said supporting surfaces comprising a curved apex portion and curved surface portions flanking and extending downwardly from said apex portion and rides unto one of said curved surface portions during downward deflection of said board.

5. The invention as recited in claim 2 wherein said supporting means includes a base and an upright member secured at one end thereof to said frame member, said upright member and said base having interacting means to effect the selective positioning of said frame member at a plurality of heights above the ground.

6. The invention as recited in claim 5 wherein said base and said upright member are operatively disposed in telescoping relation, and said interacting means operative to selectively limit the telescoping disposition of said base and upright member.

7. The invention as recited in claim 2 wherein said retaining means comprise a pair of toggle actuated devices, each said device comprising a flexible retainer and a toggle mechanism connected to said retainer, each device selectively clampable on respective end portions of said board.

8. A jouncing apparatus comprising:

a jouncing board;

a pair of substantially identical support means selectively positionable on the ground in spaced apart relation and operative to support said board in space relation above the ground;

each support means comprising a support member engaging said board, and each said support member comprises surfaces upon which said board rests and rides upon during said deflection, said surfaces effective to produce said vertical and horizontal force components transmitted by said board to said support means; and said surfaces comprise a flat apex surface and curved side surfaces defining edge portions thereat, said curved surfaces extending downwardly from said apex in flanking relation thereto wherein said board rests on said apex surface and rides onto one of said edge portions during downward deflection of said board, whereby said support member is effective to transmit a force exerted by said board to said support means during downward deflection thereof such that the vertical component of that force transmitted has a downward direction and is substantially larger than the horizontal component on that same force whereby the selective position of said support means is stabilized, and retaining means selectively disposed in engaging relation on said board and operative to prevent longitudinal movement of said board off said support means.

9. The invention as recited in claim 7 wherein said retaining means is operative to loosely retain said board in supporting relation between said support means.

10. The invention as recited in claim 7 wherein said support means includes means to selectively position said jouncing board in a plurality of space related positions above the ground.

11. The invention as recited in claim 8 wherein said retaining means comprise a pair of toggle actuated devices, each said device comprising a flexible retainer and a toggle mechanism connected to said retainer, each device selectively clampable on respective end portions of said board.

* * * * *